US005386618A

United States Patent [19]

Graf

[11] Patent Number: 5,386,618

[45] Date of Patent: Feb. 7, 1995

[54] YARN STRETCHING CHAMBER ARRANGEMENTS

[75] Inventor: Felix Graf, Winterthur, Switzerland

[73] Assignee: Rieter Machine Works, Ltd., Winterthur, Switzerland

[21] Appl. No.: 924,165

[22] Filed: Aug. 3, 1992

[30] Foreign Application Priority Data

Sep. 23, 1991 [CH] Switzerland ..... 02820/91

[51] Int. Cl.[6] ..... D02J 1/22

[52] U.S. Cl. ..... 28/246; 28/240

[58] Field of Search ..... 28/240, 246, 241, 242, 28/243, 244, 245; 264/181, 290.5, 178 R, 179, 180, 289.3, 290.7; 137/566, 563, 574, 576

[56] References Cited

U.S. PATENT DOCUMENTS

| | | | |
|---|---|---|---|
| 3,002,804 | 10/1967 | Kilian | 28/247 |
| 3,883,718 | 5/1975 | Ferment | 264/290 |
| 3,896,530 | 7/1975 | Mattingly | 28/246 |
| 4,059,668 | 11/1977 | Bittle et al. | 264/290 X |
| 4,115,054 | 9/1978 | Hermes | 28/247 |
| 4,316,312 | 2/1982 | Vermeer et al. | 28/255 |
| 4,318,210 | 3/1982 | Foster et al. | 28/246 |
| 5,046,225 | 9/1991 | Graf | 28/246 |
| 5,157,818 | 10/1992 | Voswinckel | 28/246 |

*Primary Examiner*—Clifford D. Crowder
*Assistant Examiner*—Larry D. Worrell, Jr.
*Attorney, Agent, or Firm*—Francis C. Hand

[57] ABSTRACT

The stretching chamber arrangement comprises a stretching chamber with a first closeable feed conduit, a return conduit, a liquid container and a pump for the circulation of the liquid through the stretching chamber. For premoistening the yarns to prevent dry friction during the start-up of the arrangement, a second feed conduit is provided which by-passes the closing valve of the first feed conduit and which opens out into the yarn duct through small premoistening openings situated in the direction of the yarn travel in the area of the yarn entrance in front of the first yarn guiding element of the arrangement.

20 Claims, 2 Drawing Sheets

YARN STRETCHING CHAMBER ARRANGEMENTS

Figure 1:
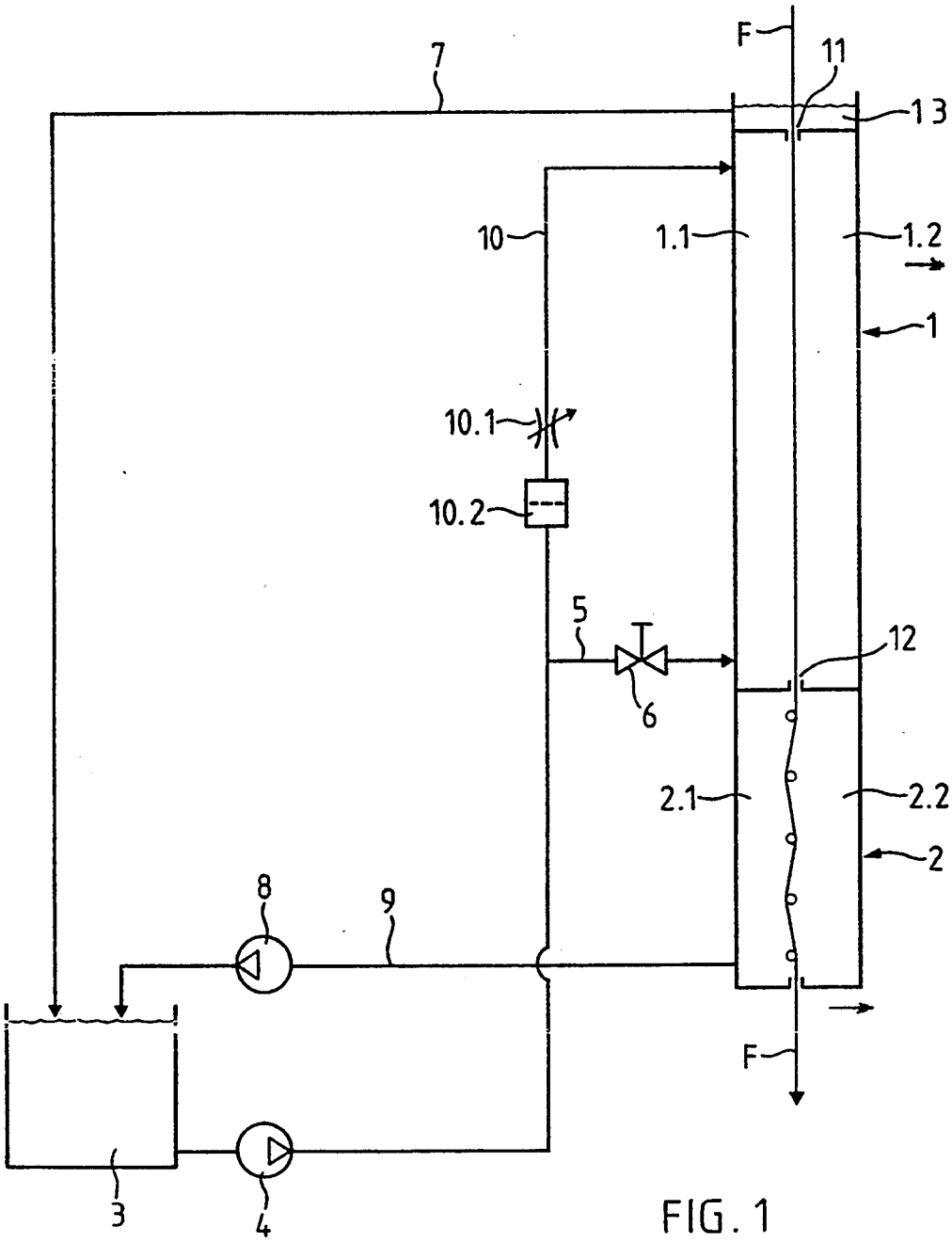

This invention relates to a yarn stretching chamber arrangement. More particularly, this invention relates to a stretching chamber arrangement for synthetic yarns and filaments.

Heretofore, it has been known to stretch synthetic filaments, in particular linear polymer filaments (non-crimped yarn) after extrusion so as to orientate the molecules of the filaments in the direction of the yarn, Preferably, liquid baths have been used for this kind of stretching wherein the stretching is carried out by a combination of hydrodynamic and mechanical braking forces. It has proved to be particularly preferable to carry out the stretching in quasi-closed chambers (stretching chambers) in which a chamber liquid is circulated in a direction which is opposite to that of the yarn. It has also proved to be preferable to attach apparatuses to such stretching chambers in which excessive liquid entrained by the yarn from the stretching chamber is separated. It is also possible to stretch several yarns in parallel in arrangements comprising stretching chambers and separating apparatuses.

Stretching chambers for carrying out the stretching process are known, for example, as described in U.S. Pat. No. 5,046,225 and corresponding European Patent Application No. 90810061.89 (publication number 0384886). Generally, such chambers are completely sealed with the exception of input and output ducts for the yarns and inlet and discharge ducts for the chamber liquid. Typically, the yarns are guided at the entrance or exit and/or within the chamber by yarn guiding elements which cause mechanical friction between the yarns and the yarn-guiding surfaces. This friction, however, is small even at very high yarn speeds, because either the yarn guiding elements are immersed in the chamber liquid or the yarn moving over the surface is saturated with liquid.

Apparatuses for separating excess liquid from the yarns are described, for example, in European Patent Application No. 91810292.2 (not published). Such apparatus may also be used in quasi-closed stretching chambers in which yarns are deflected several times about a small deflection angle with the liquid separated from the yarns being sucked off. As the apparatus for separating the excess liquid is usually arranged directly behind the stretching chamber, the yarns are usually also saturated with a liquid when they enter the chamber, so that friction between the yarn and the yarn guiding elements (deflection elements) is also small.

Problems with excessive friction and the resulting static electricity in yarns occur during the start-up of an arrangement with a stretching chamber and a separating chamber if the stretching chamber is not yet filled with liquid and the yarns move over the yarn guiding elements in a dry condition. In this case, the yarns produce so much frictional (static) electricity that it is very difficult or near impossible to guide them in a clearly separated manner over the subsequent rollers. It is also possible that breakages of the yarn occur.

Accordingly, it is an object of the invention to create a stretching chamber arrangement which prevents problems with dry friction and the resulting frictional electricity during a start-up phase.

It is another object of the invention to maintain a plurality of yarns in a clearly separated manner during passage through a yarn stretching chamber.

It is another object of the invention to reduce the risk of yarn breakage during stretching in a stretching chamber or arrangement.

Briefly, the invention provides a yarn stretching chamber arrangement comprised of a stretching chamber having an entrance duct for passage of at least one yarn into the chamber and an exit duct for exiting of the yarn from the chamber, means for feeding a liquid into the chamber, means for removing liquid from the chamber and pre-moistening means for moistening the yarn prior to the yarn entering the chamber.

The premoistening means may be disposed in the yarn entrance duct in order to moisten the yarn during entry into the chamber and thus provide the yarn with a coating of liquid so as to reduce friction.

The arrangement also includes a liquid circulation system which is connected to the means for feeding liquid into the chamber and the means for removing liquid from the chamber so that the liquid can be recycled. This circulation system also includes a conduit which extends to the premoistening means so that a portion of the liquid used for the stretching of the yarns in the chamber may also be used for moistening the yarn prior to entry into the chamber. In this respect, the conduit may be provided with an adjustable flow control mean for adjusting the flow of liquid to the premoistening means as well as a filter for filtering impurities from the flow of liquid.

In an embodiment where multiple yarns are feed into the stretching chamber, use may be made of one or more yarn guides directly upstream of the yarn entrance duct for immersion in the liquid from the premoistening means. In this way, the yarns can be maintained separated from each other via the guides while friction is reduced to a minimum.

Figure 2:
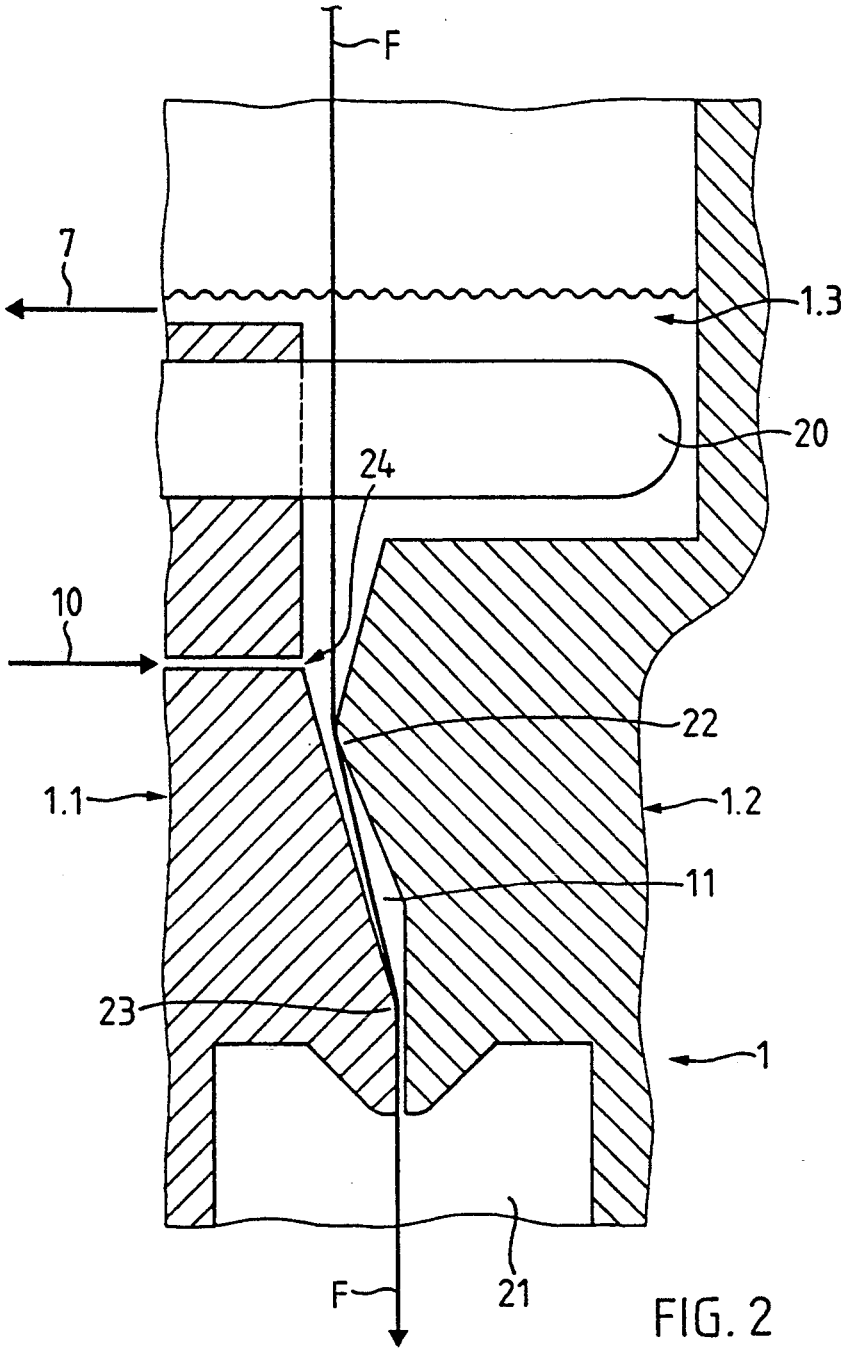

These and other objects and advantages of the invention will become more apparent from the following detailed description taken in conjunction with the accompanying drawings wherein:

FIG. 1 illustrates a schematic view of a stretching chamber arrangement constructed in accordance with the invention; and FIG. 2 illustrates a cross sectional view of a yarn entrance end of a stretching chamber constructed in accordance with the invention.

Referring to FIG. 1, the yarn stretching chamber arrangement employs a stretching chamber 1 and a separating chamber 2 situated vertically below the stretching chamber 1. The stretching chamber 1 serves to stretch at least one yarn F passing therethrough while the separating chamber 2 serves to separate water from the yarns F passing therethrough.

The stretching chamber 1 and the separating chamber 2 preferably each consists of two parts 1.1, 1.2, 2.1, 2.2 in such a way that the chambers 1, 2 can be opened parallel to the plane in which the yarns F substantially pass through the chambers.

As indicated, the stretching chamber 1 has a yarn entrance duct 11 at the upper end for passage of at least one yarn into the chamber and a yarn exit duct 12 at a lower end for exiting of the yarn from the stretching chamber 1 into the separating chamber 2.

The arrangement also includes a circulating system for circulating a liquid through the stretching chamber 1 for passage of the yarn F therethrough in counter-current relation. This circulating system includes a liquid container or tank 3 containing a supply of liquid, a conveying pump 4 for pumping liquid from the tank 3 through a feed conduit 5 which serves as a means for feeding liquid into the lower end of the stretching chamber 1. As indicated, a valve 6 is disposed in the feed conduit 5 to control the flow of liquid into the stretching chamber 1.

The circulating system also includes a means in the form of a return conduit 7 for removing liquid from the stretching chamber 1. This return conduit 7 extends from an overflow 1.3 situated at the top of the stretching chamber 1 to the tank 3.

The circulating system also includes a suction pump 8 which communicates via a suction conduit 9 with a lower end of the separating chamber 2 so as to draw off liquid from the separating chamber 2 for delivery into the tank 3 for recirculation purposes.

As indicated in FIG. 1, the three conduits 5, 7, 9 are connected to the parts 1.1, 2.1 of the chambers 1, 2 which preferably remains stationary whereas the other parts 1.2, 2.2 are movable to an opened position.

As indicated in FIG. 1, a premoistening means is provided for moistening the yarn F prior to the yarn F entering the stretching chamber 1. This premoistening means is in the form of a second feed conduit 10 which extends from the first feed conduit 5 in parallel relation upstream of the valve 6 relative to the flow of liquid therethrough. This feed conduit 10 has at least one opening 24 (see FIG. 2) into the stretching chamber which is directed toward a yarn F passing thereby. As indicated, the feed conduit 10 bypasses the valve 6 which means that the conduit 10 cannot be blocked. Further, the feed conduit 10 leads to the area of the yarn entrance duct 11 of the stretching chamber 1, preferably before the first yarn guiding element (not shown) of the arrangement as viewed in the direction of yarn transfer. As indicated in FIG. 2, the feed conduit 10 opens out in the manner of the other liquid conduits 5, 7, 9 into the stationary part 1.1 of the stretching chamber 1. In this respect, the feed conduit 10 has a plurality of mouths, each of which is directed towards a respective yarn F passing through the stretching chamber and each is so small that only a very small amount of liquid can flow out towards the yarn F even at full power of the conveying pump 4. The amount is just about sufficient to moisten the yarns F and reduce the friction between the yarns and the subsequent yarn guiding elements.

As shown in FIG. 1, an adjustable flow control means 10.1 is provided in the feed conduit 10 for adjusting the flow of liquid to the opening 24. In addition, a filter 10.2 is disposed in the feed conduit 10 upstream of the flow control means 10.1 for filtering impurities from the flow of liquid in the conduit 10.

In order to start up the stretching chamber arrangement, the following procedure is performed:

The chambers are closed without any passing yarns, valve 6 is opened, conveying pump 4 and suction pump 8 are started, i.e., liquid circulates from the first feed conduit 5 through the stretching chamber 1 towards return conduit 7. Liquid is also conveyed through the second feed conduit 10 and flows out from the premoistening openings, which do not have a substantial influence on the circulation of the liquid. A part of the liquid leaves the stretching chamber 1 through the yarn exit duct 12 into the separation chamber 2 where the liquid is sucked off by the suction pump 8. As soon as the liquid in the tank 3 and in the stretching chamber 1 has reached the scheduled temperature, valve 6 is closed, so that the stretching chamber 1 only receives liquid through the second feed conduit 10, which flows off through the yarn exit duct 12 and which is sucked off by the suction pump 8.

As soon as the stretch chamber 1 is empty, chambers 1 and 2 can be opened. Liquid still flows out from the premoistening openings and flows downwards along the stationary chamber sections 1.1 and 2.1 to be sucked into the suction conduit 9, so that the yarn guiding elements in the stationary chamber sections remain moistened.

The yarns are placed on the stationary chamber parts 1.1 and 2.2 by means of a suction gun and placed over a first stretch roller following the stretching chamber 1.

Chambers 1 and 2 are closed, which causes the friction primarily in the separating chamber 2 to rise quickly due to the increased deflection of the yarns. During this time, the yarns are moistened by the liquid introduced through the premoistening openings independently of the liquid filling level in the stretching chamber 1.

Valve 6 is opened, so that the stretching chamber 1 is filled with liquid.

As soon as the overflow 1.3 of the stretching chamber 1 has reached an adequate level, the yarns are applied to a winder (not shown) with the suction gun and automatic operation can continue.

For the premoistening process, it has proved to be preferable if the liquid is introduced from one premoistening opening for each of the yarns, whereby the premoistening openings should be at least as wide as the fibril ribbons. The area of cross section of the premoistening openings is dimensioned in such a way that the liquid flows out from the opening slowly instead of shooting out in a jet. This is the only way to ensure that while the chamber is opened the liquid emerging from the premoistening openings is reliably sucked into the suction conduit 9 of the separation chamber 2.

The weight of liquid feed by the premoistening openings should amount to 2 to 30% of the passing yarn weight. It is possible to provide the adjustment by the dimension of the opening 24, by the adjustable flow control means 10.1 and/or by feed pressure of the conveying pump 4.

To prevent blockages of the premoistening openings, impurities are removed from the chamber liquid before they reach the premoistening openings by providing the filter 10.2.

Referring to FIG. 2 which illustrates a section parallel to the direction of yarn travel and vertical to the plane in which the yarns F pass through the chamber, a plurality of yarn guides 20 (only one of which is shown) is disposed directly upstream of the yarn entrance duct 11 for immersion in the liquid from the premoistening means. These yarn guides 20 serve to separate the individual yarns F passing into the entrance duct 11 and, in turn, are completely immersed in the liquid in the overflow 1.3 so as to reduce any friction forces between the yarns F and the guides 20.

As indicated in FIG. 2, the yarn entrance duct 11 has a pair of deflection positions 22, 23 which guide the yarns F before entry into a hollow stretching compartment 21 of the stretching chamber 1. These deflection positions 22, 23 serve to slightly deflect the yarns after passage by the openings 24 of the premoistening means. Of note, each opening 24 may have a cross section of 0.2 millimeters by 1.5 millimeters.

During operation, both yarn deflection positions 22, 23 as well as the separating elements 20 are immersed in the chamber liquid which reaches up to the overflow 1.3 on the stretching chamber, so that the friction produced thereon remains small. As long as the level of the liquid has not reached the overflow 1.3 during start-up, the yarn and/or the yarn guiding elements 20 are sufficiently moistened by the liquid emerging from the premoistening openings 24 so as to prevent an untolerably high mechanical braking action of the yarns by dry friction.

A further embodiment consists of guiding the second feed conduit 10 onto known application yarn guides which are arranged directly in front of the stretching chamber. Such an arrangement of the premoistening means outside of the stretching chamber can also prevent dry friction on the separating elements disposed in front of the yarn entrance duct. However, the apparatus then becomes considerably more complex because, for example, during application, the premoistening liquid must be applied to the yarns in precisely controlled amounts, because any excessive application of the liquid would soil the following machinery.

The invention thus provides a stretching chamber arrangement in which yarns passing through a stretching chamber are premoistened during the insertion of the yarn into the chamber. The yarns entering the chamber are thus moistened with chamber liquid before reaching the first guide elements over which the yarns may otherwise move under a friction force.

The invention further provides a relatively simple arrangement for modifying existing stretching chambers so as to reduce the possibility of static friction from occurring in a stretching chamber at start-up.

I claim:

1. A yarn stretching chamber arrangement comprising a stretching chamber having a stretching compartment, a yarn entrance duct for passage of at least one yarn into said compartment and a yarn exit duct for exiting of the yarn from said compartment;

means for feeding a liquid into said compartment for filling the chamber for passage of the yarn therethrough;

means for removing liquid from said compartment after passage of the yarn therethrough; and premoistening means for moistening the yarn independent of the liquid filling level in said compartment prior to the yarn entering said compartment.

2. An arrangement as set forth in claim 1 wherein said premoistening means is disposed in said yarn entrance duct.

3. An arrangement as set forth in claim 1 wherein said means for feeding liquid into said compartment is connected to said premoistening means to deliver liquid thereto for moistening of the yarn.

4. An arrangement as set forth in claim 1 which further comprises a liquid circulation system connected to and between said means for feeding liquid and said means for removing liquid.

5. An arrangement as set forth in claim 4 wherein said means for feeding liquid is a first feed conduit, said means for removing liquid is a return conduit, and said circulation system includes a liquid container connected to each said conduit, a pump in said feed conduit for pumping liquid through said feed conduit to said compartment and a valve in said feed conduit for controlling the flow of liquid therethrough.

6. An arrangement as set forth in claim 5 wherein said premoistening means includes a second feed conduit extending from said first feed conduit upstream of said valve relative to a flow of liquid therethrough and at least one opening in said chamber directed toward a yarn passing thereby.

7. An arrangement as set forth in claim 6 wherein said opening is disposed in said yarn entrance duct.

8. An arrangement as set forth in claim 7 wherein said chamber comprises a stationary section and a movable section movably mounted relative to said stationary section to define a passage therebetween for the yarn, and wherein said opening of said premoistening means is disposed in said stationary part.

9. An arrangement as set forth in claim 8 wherein said premoistening means includes a plurality of openings disposed horizontally and at a spacing equal to a spacing between a plurality of yarns passing through said chamber.

10. An arrangement as set forth in claim 9 wherein said openings and said pump are sized to feed a liquid quantity therethrough equal from 2 to 30% of the passing yarn weight.

11. An arrangement as set forth in claim 6 which further comprises an adjustable flow control means in said second feed conduit for adjusting the flow of liquid to said opening.

12. An arrangement as set forth in claim 11 which further comprises a filter in said second feed conduit for filtering impurities from the flow of liquid in said second feed conduit.

13. An arrangement as set forth in claim 1 which further comprises at least one yarn guide directly upstream of said yarn entrance duct relative to a direction of yarn travel for immersion in liquid from said premoistening means.

14. An arrangement as set forth in claim 1 wherein said chamber includes an overflow at an upper end for receiving liquid from said chamber for delivery to said means for removing liquid and which further comprises at least one yarn guide in said overflow.

15. A yarn stretching chamber arrangement comprising a stretching chamber having a stretching compartment for stretching of a travelling yarn therein, a yarn entrance duct for passage of at least one yarn into said compartment and a yarn exit duct for exiting of the yarn from said compartment;

first means for feeding a liquid into said compartment to fill the chamber; and premoistening means for moistening a yarn in said yarn entrance duct and in said compartment prior to filling of the compartment with liquid from said first means to prevent dry friction on the yarn in said compartment during start-up.

16. A yarn stretching chamber arrangement comprising a stretching chamber for stretching of at least one yarn passing therethrough, said chamber having a stretching compartment, an entrance duct for passage of the yarn into said compartment and an exit duct for passage of the yarn out of said compartment;

a circulating system for circulating a liquid through said compartment; and a premoistening means for moistening the yarn prior to the yarn passing into said compartment, said premoistening means including a feed conduit for delivering liquid and at least one opening in said chamber communicating with said feed conduit and directed into said entrance duct to deliver liquid onto a yarn passing therethrough.

17. An arrangement as set forth in claim 16 wherein said entrance duct includes a pair of spaced apart yarn guiding elements for guiding the yarn thereover downstream of said opening of said premoistening means.

18. An arrangement as set forth in claim 17 which further comprises an overflow on said chamber and above said entrance for receiving liquid therein from said premoistening means and said chamber.

19. An arrangement as set forth in claim 16 wherein said feed conduit is connected to said circulating system to receive liquid therefrom.

20. An arrangement as set forth in claim 19 which further comprises an adjustable flow control means in said feed conduit for controlling the flow of liquid therethrough.

* * * * *